US012030593B2

(12) United States Patent
Fafard et al.

(10) Patent No.: US 12,030,593 B2
(45) Date of Patent: Jul. 9, 2024

(54) WATERCRAFT SWIM PLATFORM WITH DEPLOYABLE STEPS

(71) Applicant: Chaparral Boats, Inc., Nashville, GA (US)

(72) Inventors: Michael J. Fafard, Nashville, GA (US); Michael Anthony Werle, Nashville, GA (US); Justin Everett Brooks, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 0 days.

(21) Appl. No.: 18/243,830

(22) Filed: Sep. 8, 2023

(65) Prior Publication Data

US 2023/0415857 A1 Dec. 28, 2023

Related U.S. Application Data

(63) Continuation of application No. 17/876,892, filed on Jul. 29, 2022, now Pat. No. 11,780,537, which is a continuation of application No. 16/994,826, filed on Aug. 17, 2020, now Pat. No. 11,401,012.

(60) Provisional application No. 62/948,492, filed on Dec. 16, 2019, provisional application No. 62/887,995, filed on Aug. 16, 2019.

(51) Int. Cl.
*B63B 27/14* (2006.01)
*B63B 29/02* (2006.01)

(52) U.S. Cl.
CPC ..... *B63B 27/146* (2013.01); *B63B 29/02* (2013.01); *B63B 2029/022* (2013.01)

(58) Field of Classification Search
CPC .. B63B 27/146; B63B 29/02; B63B 2029/022
See application file for complete search history.

(56) References Cited

U.S. PATENT DOCUMENTS 7,121,226 B2 10/2006 Grimaldi
8,375,880 B1 2/2013 St. Clair, Jr. et al.
(Continued)

FOREIGN PATENT DOCUMENTS

WO WO-2014181269 A1 * 11/2014 ..... B63B 27/143

OTHER PUBLICATIONS

[No Author Listed] [online], "2014 Cobalt Boats Hydraulic Swim Platform," published on Sep. 10, 2013, retrieved on Apr. 8, 2021, retrieved from URL<https://www.youtube.com/watch?v=XtOZNpSDaTM>, 1 pages.
(Continued)

*Primary Examiner* — Stephen P Avila
(74) *Attorney, Agent, or Firm* — Fish & Richardson P.C.

(57) ABSTRACT

Boats can include a swim platform with an integrated system of steps that can be selectively deployed and retracted. Such platforms can be attached to a transom of a boat or can be fabricated as an extended portion of the boat's hull. In another embodiment, deployable steps can be integrated with a boat's hull as a side-entry door. In order to reconfigure the step system into a deployed configuration, a linkage is actuated that causes the step system to unfold, forming steps (or a seating configuration) at least partially below the water line. Since the steps can be deployed below the water line, a swimmer can more easily get on board the boat.

10 Claims, 6 Drawing Sheets

(56) References Cited

U.S. PATENT DOCUMENTS

| | | | |
|---|---|---|---|
| 8,833,290 | B2 | 9/2014 | Mueller |
| 10,399,645 | B1 | 9/2019 | Holmes |
| 11,401,012 | B2 | 8/2022 | Fafard |
| 2021/0047005 | A1 | 2/2021 | Fafard |

OTHER PUBLICATIONS

[No Author Listed] [online], "Hydraulic Swim Platform with Integrated Steps," published on Mar. 2, 2016, retrieved on Apr. 8, 2021, retrieved from URL<https://www.youtube.com/watch?v=FmBut4W3MHw>, 1 page.

* cited by examiner

WATERCRAFT SWIM PLATFORM WITH DEPLOYABLE STEPS

CROSS-REFERENCE TO RELATED APPLICATIONS

This application is a continuation of and claims benefit of U.S. application Ser. No. 17/876,892 filed Jul. 29, 2022, which is a continuation and claims benefit of U.S. application Ser. No. 16/994,826 (U.S. Pat. No. 11,401,012) filed Aug. 17, 2020, which claims benefit of and priority to U.S. Provisional Application Ser. No. 62/887,995, filed Aug. 16, 2019, and U.S. Provisional Application Ser. No. 62/948,492, filed Dec. 16, 2019. The contents of the prior applications are incorporated herein by reference in their entirety.

BACKGROUND

This document relates to devices and systems for boating. For example, this document relates to boat platforms with an integral step system that can be selectively deployed and retracted in relation to the boat and the water level.

Platforms of various types can be attached to a boat. For example, in some cases a particular type of platform known as a swim platform is attached to an aft portion of a boat. Swim platforms generally provide a means by which people can move between the boat and the water. Swim platforms are typically stationary in relation to the boat, and located above the waterline.

SUMMARY

Some watercraft platforms described herein include an integrated system of steps that can be selectively deployed and retracted. In some embodiments, such platforms can be integrated into a swim platform that is attached to a transom of a boat or fabricated as an extended portion of the boat's hull. In some embodiments, such platforms can be integrated with a boat's hull as a side-entry door.

When integrated into a swim platform, the platform can have a generally planar continuous upper platform surface while the platform is in the retracted configuration. One of the steps of the step system can make up a portion of the generally planar continuous upper platform surface. In order to reconfigure the step system into a deployed configuration, a linkage is actuated that causes the step system to unfold, forming steps (or a seating configuration). The deployed steps can be below the water line. The fact that the steps are below the water line can enhance the utility of the platform because, for example, while the steps are in the deployed configuration a swimmer can more easily get on board the boat.

When integrated into a hull as a side-entry door, the platform can have a vertical orientation corresponding to the surrounding hull, and the platform can pivot to a horizontal orientation that creates a side opening in the hull. From the horizontal orientation, the step system can be deployed to unfold, forming steps (or a seating configuration). The deployed steps can be below the water line.

In one aspect, this disclosure is directed to a deployable step system for a watercraft that includes a first platform; a second platform; and a linkage that connects both of the first platform and the second platform to a boat. In some embodiments, the linkage is connected to each of the first platform and the second platform in a manner that (i) enables the first platform to rotate at least ninety degrees between a retracted state to a deployed state, and (ii) enables the first platform to transition from a location that is above the second platform in the retracted state to a location that is below the second platform in the deployed state. In some embodiments, each of the first platform and the second platform are located below a swim platform of the boat while the first platform and the second platform are in the deployed state.

In another aspect, this disclosure is directed to a deployable step system for a watercraft. The system can include: a first platform, a second platform, and a linkage movably coupling the first and second platforms together such that the system is reconfigurable from a retracted configuration to a deployed configuration in which the first and second platforms each move to create steps. In some embodiments, the first platform is above the second platform while the system is in the retracted configuration, and the first platform is below the second platform while the system is in the deployed configuration.

In another aspect, this disclosure is directed to watercraft swim platform system. The system includes: a swim platform with an upper surface, and a deployable step system integrated with the swim platform. The deployable step system can include a first platform, a second platform, and a linkage movably coupling the first and second platforms together such that the system is reconfigurable between: (i) a retracted configuration in which the first platform forms a portion of the upper surface of the swim platform and (ii) a deployed configuration in which the first and second platforms create two steps that are each below the upper surface of the swim platform.

In another aspect, this disclosure is directed to a deployable step system for marine use. The deployable step system can include: a first platform having first and second surfaces on opposite sides thereof; a second platform having third and fourth surfaces on opposite sides thereof; and a linkage movably coupling the first and second platforms together such that the system is reconfigurable between a retracted configuration and a deployed configuration in which the first and second platforms create steps. In some embodiments, the first and third surfaces face upward while the system is in the retracted configuration, and the second and the third surfaces face upward while the system is in the deployed configuration.

The deployable step systems disclosed herein may optionally include one or more of the following features. The system may also include one or more actuators coupled to the linkage and operable to drive reconfiguration of the system between the retracted configuration and the deployed configuration. In some embodiments, the one or more actuators is a linear actuator. The linkage may include a hard stop such that while the system is in use in the deployed configuration the hard stop bears forces applied by the use rather than the one or more actuators. In some embodiments, as the system reconfigures from the retracted configuration to the deployed configuration: (i) the first platform pivots by at least ninety degrees and (ii) the second platform pivots less than 90 degrees. The systems may also include a swim platform with which the system is integrated. Such a swim platform may be configured for extending from a transom of a boat. The system may also include a first upright panel disposed between the second platform and the swim platform while the system is in the deployed configuration. The system may also include a second upright panel disposed between the first and second platforms while the system is in the deployed configuration.

Particular embodiments of the subject matter described in this document can be implemented to realize one or more of the following advantages. First, in some implementations the boat platforms with an integral step system described herein advantageously facilitates convenient movement of people between the boat and the water. For example, when access to the boat from the water is desired, the steps can be deployed from the swim platform (e.g., to below the waterline in some embodiments). Such an arrangement can allow a swimmer easier access to the boat from the water as compared to a traditional fixed/immovable swim platform or to a ladder.

Second, some implementations of the boat platforms with an integral step system can be advantageously used in conjunction with virtually any type and size of boat, such as jet boats, sterndrive boats, inboard boats, outboard boats, sailboats, deck boats, pontoon boats, catamarans, personal watercraft, and so on. The platform with an integral step system can also be advantageously integrated with other water-related equipment or facilities such as swim rafts, docks, pool decks, and so on.

Third, in some implementations the boat platforms with an integral step system described herein can be integrally manufactured as part of a boat during the manufacturing process of the boat. Alternatively, in some implementations the boat platform with an integral step system described herein can be individually made and advantageously attached to a portion of a previously existing boat. Hence, an individual may be able to purchase one of the boat platforms with an integral step system described herein and add it onto the previously existing boat.

Fourth, the boat platforms with an integral step system described herein can be retracted so that the steps do not drag in the water while boat is in motion. Hence, the boat's top speed and fuel economy are not detrimentally affected by the presence of the boat platforms with an integral step system.

Fifth, in some embodiments the step system described herein can be integrated with a boat's hull as a side-entry door. Such an arrangement can be particularly advantageous for a boat that is powered by one or more outboard motors. In addition to the utility of the side-entry door, the step system can be deployed as a seat or steps.

Sixth, in some implementations the boat platforms with an integral step system described herein can enhance activities such as swimming, water skiing, accessing adjacent watercraft, docking, and so forth. For example, one particular advantage of the selectively deployable steps is to facilitate easier movement by swimmers into and out of the water, as opposed to having to climb over the gunwales or stern of the boat's hull. Moreover, swim platforms can enhance boating safety by providing an access to and from the boat that is located farther away from the boat's propeller as compared to a boat without a swim platform.

Seventh, the step system described herein can be configured so as to provide a seating area for people. The seating area can be below water while the step system is deployed, and include a footrest in addition to a seat.

Although methods and materials similar or equivalent to those described herein can be used to practice the invention, suitable methods and materials are described herein. In addition, the materials, methods, and examples are illustrative only and not intended to be limiting.

The details of one or more embodiments of the invention are set forth in the accompanying drawings and the description herein. Other features, objects, and advantages of the invention will be apparent from the description and drawings, and from the claims.

DESCRIPTION OF THE DRAWINGS

Like reference numbers represent corresponding parts throughout.

DETAILED DESCRIPTION

This document describes devices and systems for boating. For example, this document describes watercraft platforms that include an integrated system of steps that can be selectively deployed and retracted. In some embodiments, such platforms can be attached to a transom of a boat or can be fabricated as an extended portion of the boat's hull. When the step system is in a retracted configuration, the platform can have a generally planar continuous upper platform surface. One of the steps of the step system can make up a portion of the generally planar continuous upper platform surface.

This document also describes a selectively deployable step system that is integrated into the side hull of a boat as a side-entry door. The side-entry door has a closed configuration and an open configuration. While in the open configuration, the step system of the side-entry door can be deployed to extend laterally from the hull of the boat.

In order to reconfigure the step system into a deployed configuration, a linkage is actuated that causes the step system to unfold, forming steps (or a seating configuration) at least partially below the water line. The fact that the steps are below the water line enhances the utility of the platform because, for example, while the steps are in the deployed configuration a swimmer can more easily get on board the boat. The system of steps described herein can also form a seat for people to rest or lounge in the water.

Figure 1:
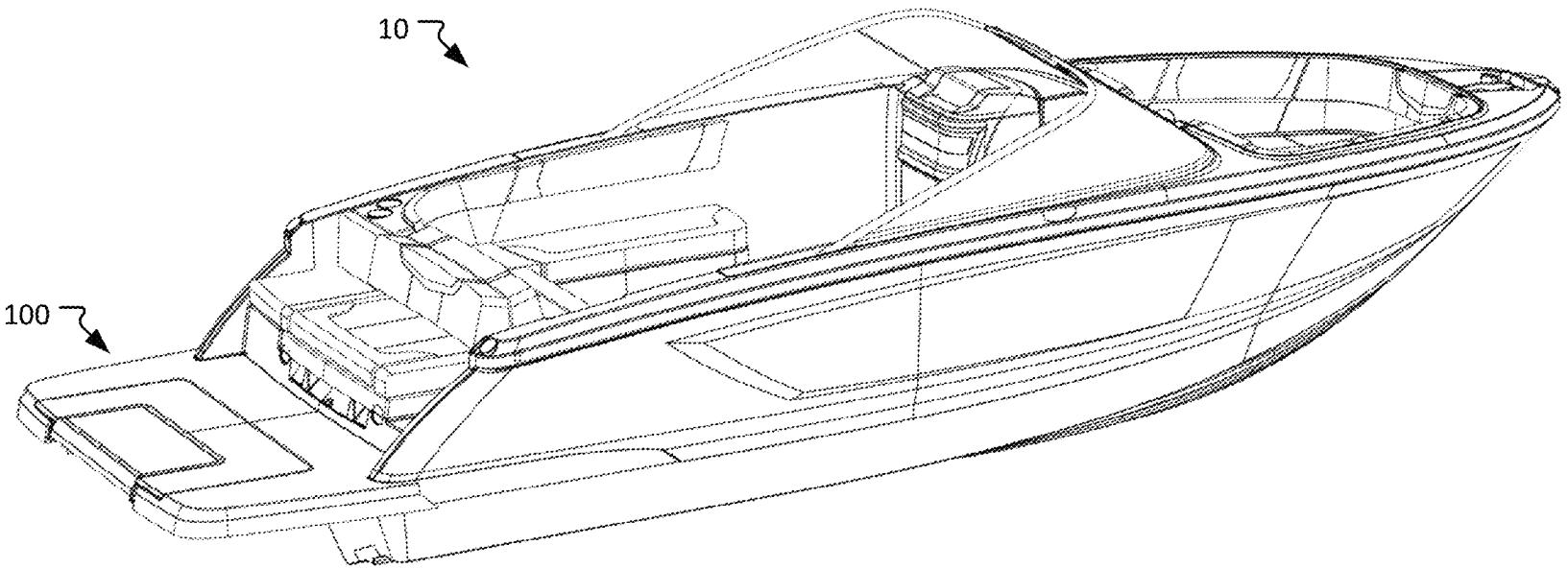
FIG. 1 is a perspective view of a boat and a boat-mounted aft swim platform with an integral deployable step system in accordance with some embodiments. The deployable step system is shown in a retracted configuration.

Referring to FIG. 1, a boat 10 includes an example swim platform assembly 100 extending from an aft portion of the boat 10. As described further below, the example swim platform assembly 100 includes an integrated system of steps that can be selectively deployed and retracted. While an open-bow sport boat 10 is illustrated as having the example swim platform assembly 100 with the integrated system of steps, it should be understood that the innovative concepts of the swim platform assembly 100 can be incorporated with many other types of watercraft and water-related facilities.

While in the depicted embodiment the swim platform assembly 100 is located aft in relation to the boat 10, such an arrangement is not required in all embodiments. For example, in some embodiments, the swim platform assembly 100 is located on a side of the boat 10, or the bow of the boat 10. In some embodiments, two or more of the swim platform assemblies 100 can be included on a single boat 10.

In some embodiments, the swim platform assembly 100 with the system of steps is integrated with the boat 10 as part of the manufacturing process of the boat 10. Alternatively, in some embodiments the swim platform assembly 100 with the integrated system of steps is added onto a previously existing boat 10 as an aftermarket accessory.

Figure 2:
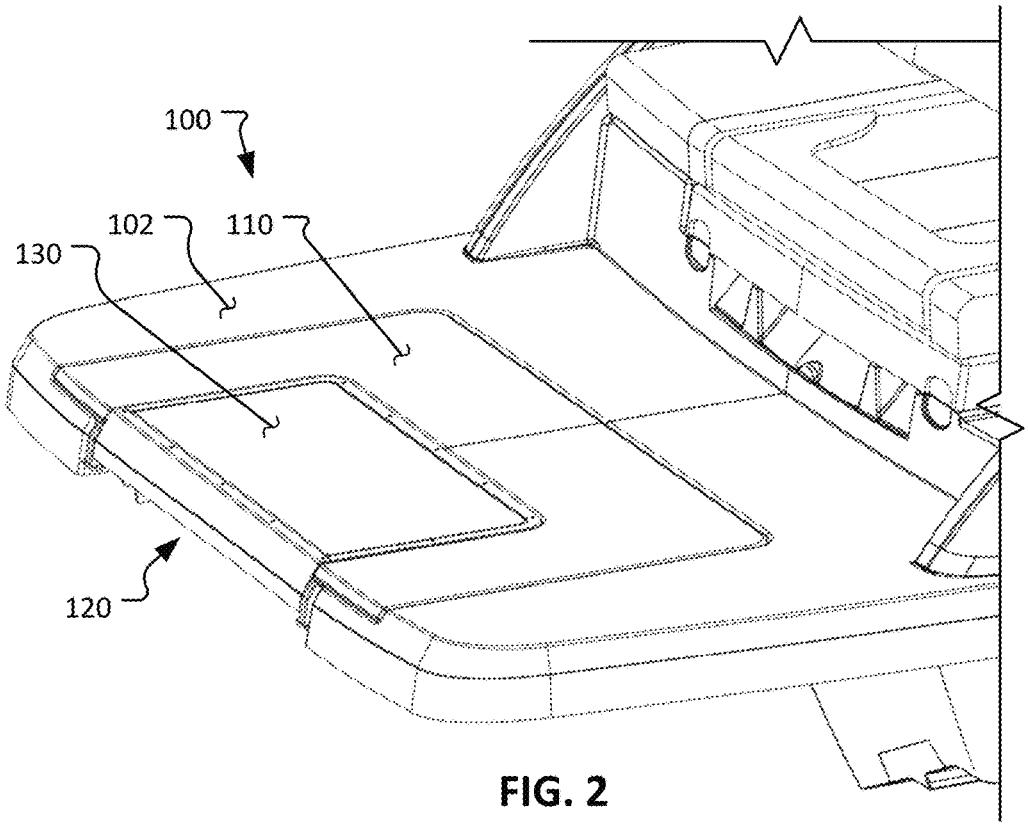
FIG. 2 is an enlarged perspective view of the boat-mounted aft swim platform and integral deployable step system of FIG. 1, shown in the retracted configuration.

FIG. 2 shows a larger view of the example swim platform assembly 100 with the integrated system of steps 120. Here the steps 120 of the swim platform assembly 100 are in a retracted configuration. The upper planar surface of the swim platform assembly 100 is made up of a fixed surface 102, a movable access panel 110, and an underside surface of a first platform 130 (which may also be referred to as a first step 130). The upward facing surfaces of the fixed surface 102, the access panel 110, and the first platform 130 are at the same, or essentially the same, elevation such that the surfaces combine to form a generally contiguous, planar upper surface of the swim platform assembly 100 while the steps 120 are in the retracted configuration as shown. In some embodiments, the access panel 110 is manually removable. In some embodiments, the access panel 110 is automatically movable.

Figure 3:
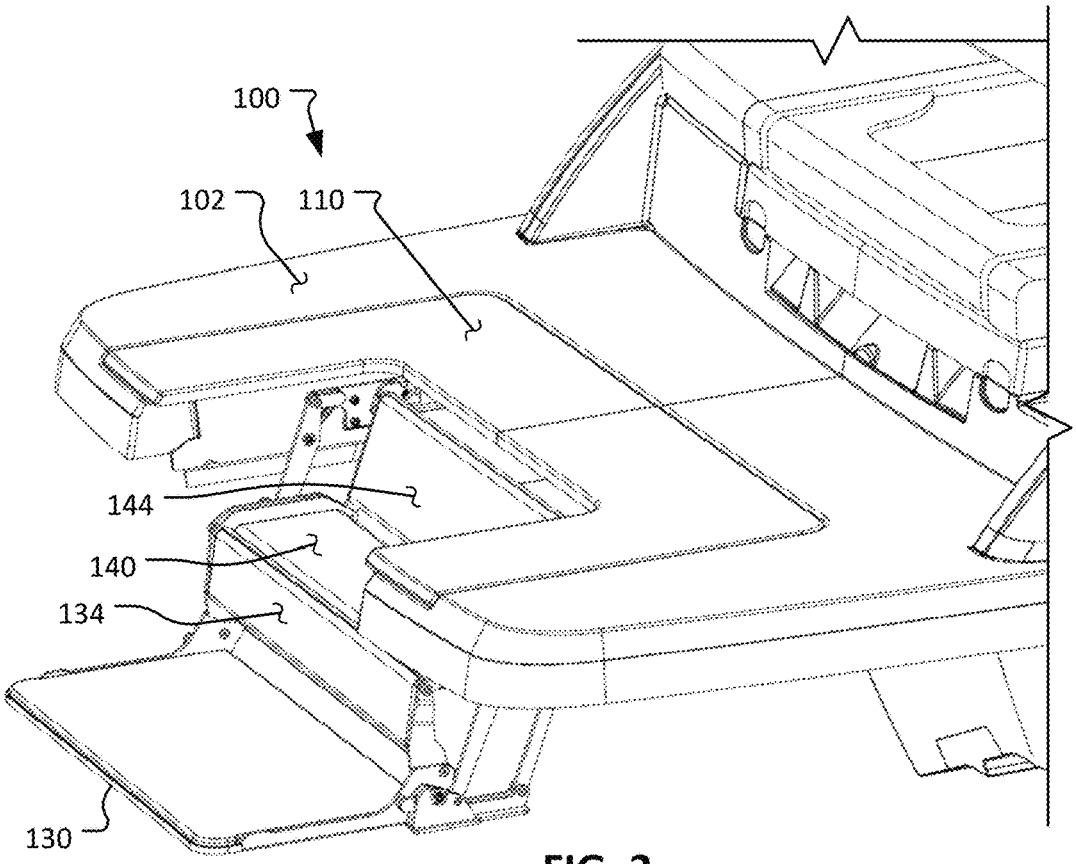
FIG. 3 is an enlarged perspective view of the boat-mounted aft swim platform and integral deployable step system of FIG. 1, shown in a deployed configuration.
Figure 4:
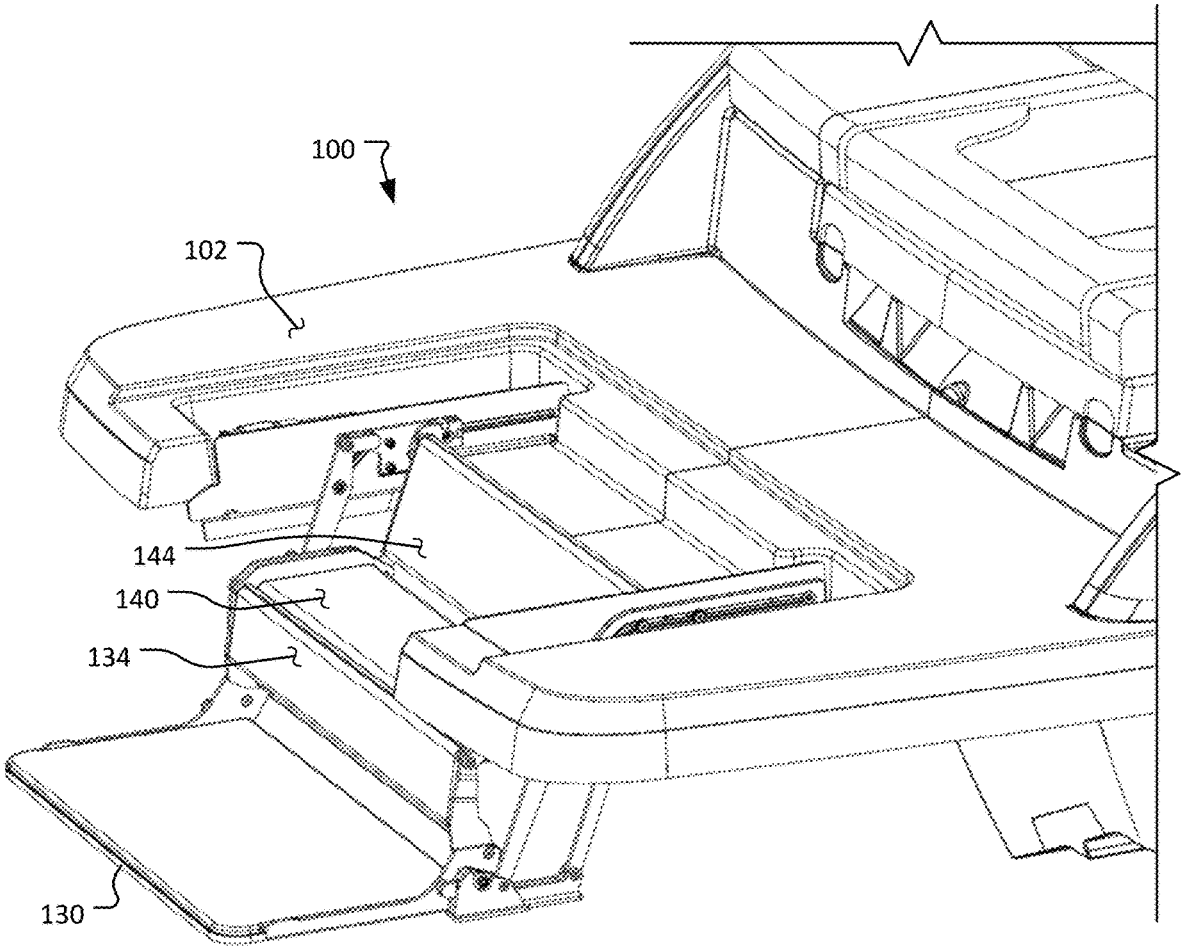
FIG. 4 is another view of the boat-mounted aft swim platform and integral deployable step system of FIG. 1, shown in a deployed configuration and with a cover portion removed for enhanced visibility of a linkage that controls movements of the step system.

Referring also to FIGS. 3 and 4, the example swim platform assembly 100 with the steps 120 is reconfigurable from the retracted configuration (FIG. 2) to a deployed configuration that creates one or more steps (and/or seating areas) below the waterline. In FIG. 4, the access panel 110 is removed (or retracted/stowed) to allow for enhanced visualization of the mechanical linkage that controls movements of the steps 120 (as described further below).

While the deployable portion of the swim platform assembly 100 is referred to herein as steps 120, it can be seen that the deployable portion can also be said to form a seat that includes a seatback (e.g., 144), a seating surface (e.g., 140), and a footrest (e.g., 130). Such a seat can be wide enough for a single person, two people, three people, or more.

The deployable steps 120 include the first platform 130 and a second platform 140 (which may also be referred to as a second step 140). In the deployed configuration as shown, the first platform 130 is below the second platform 140, and the second platform 140 is below the fixed surface 102 of the swim platform assembly 100. In contrast, in the retracted configuration (FIG. 2), the first platform 130 is above the second platform 140 (not visible in FIG. 2).

In some embodiments, the steps 120 can be selectively positioned to, and maintained in, any desired vertical orientation along a continuum of positions between the retracted configuration (e.g., as shown in FIG. 2) and the deployed configuration (e.g., as shown in FIGS. 3 and 4).

The first platform 130 and the second platform 140 can be made from various types of materials and combinations of materials. For example, in some embodiments the platforms 130 and 140 are made of fiberglass, aluminum, stainless steel, wood (e.g., teak), plastics, or combinations thereof. In some embodiments, the platforms 130 and 140 are configured for reduced slipperiness (e.g., with one or more high-friction surfaces). In some embodiments, one or more openings (e.g., slots, holes, etc.) exist in the platforms 130 and 140 so that water can pass through the platforms 130 and/or 140. For example, in some embodiments the platforms 130 and 140 are made at least partially of expanded stainless steel.

The deployable steps 120 also include (while deployed) a first upright panel 144 that is disposed between the second platform 140 and the fixed surface 102 of the swim platform assembly 100, and a second upright panel 134 that is disposed between the first platform 130 and the second platform 140. The first upright panel 144 or the second upright panel 134 can serve as a backrest while the steps 120 are used as a seat. The first upright panel 144 and the second upright panel 134 can be made of the same materials and construction as the platforms 130 and 140.

Figure 5:
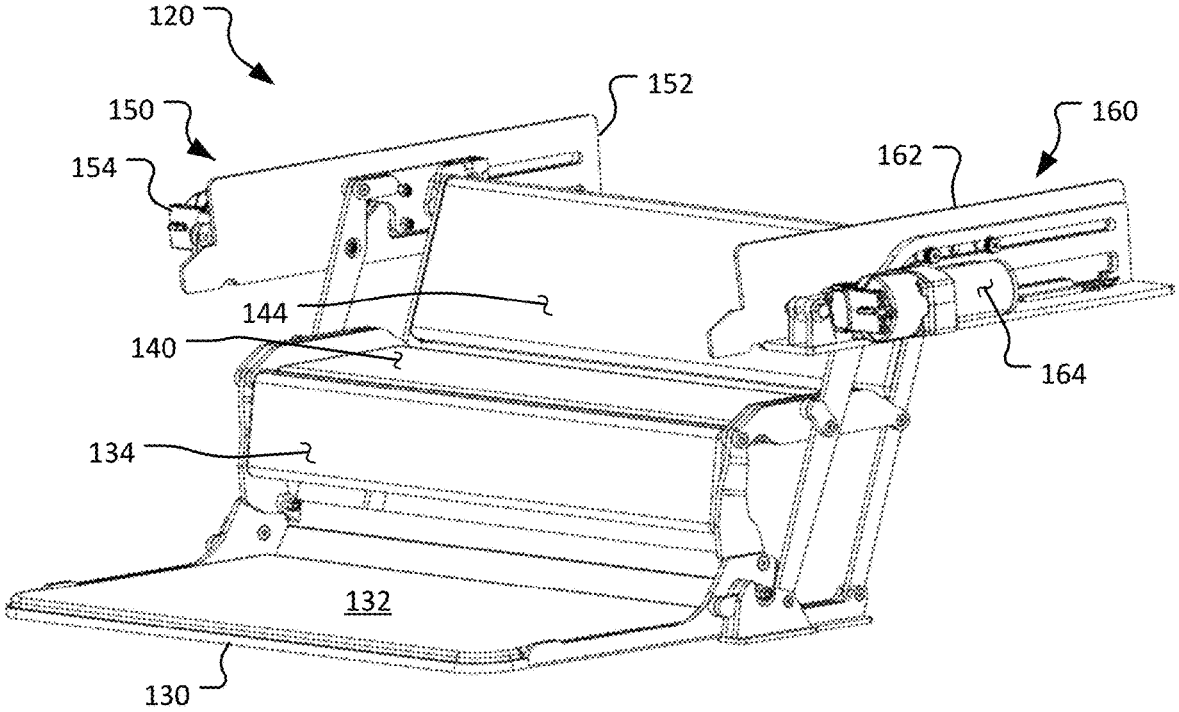
FIG. 5 is a perspective view of the deployable step system of FIG. 1 shown in isolation from other portions of the swim platform and in the deployed configuration.
Figure 6:
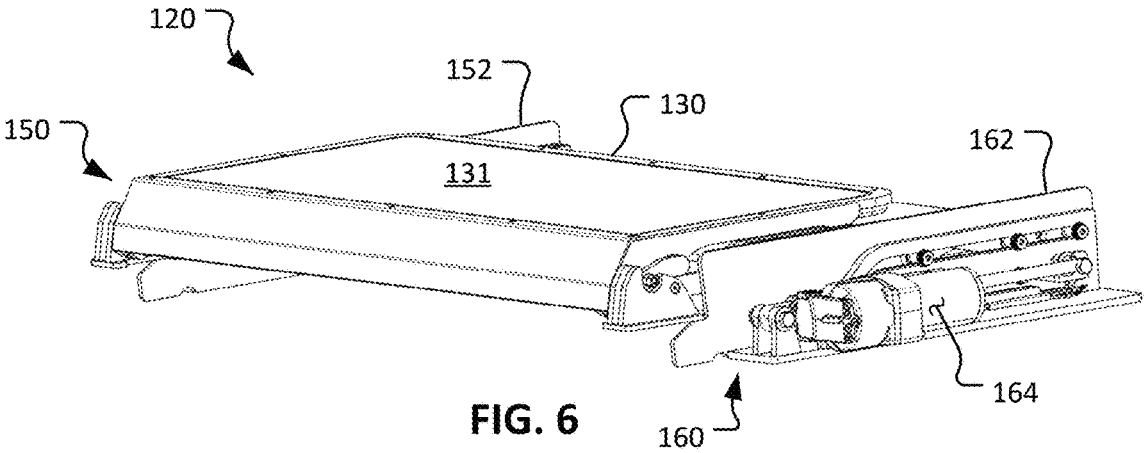
FIG. 6 is a perspective view of the deployable step system of FIG. 1 shown in isolation from other portions of the swim platform and in the retracted configuration.

Referring to FIGS. 5 and 6, here the system of deployable steps 120 is shown separately from the other portions of the swim platform so that the construction and operation of the deployable steps 120 is more visibly evident. The deployable steps 120 include a first linkage assembly 150 and a second linkage assembly 160 (that can be jointly referred to as a "linkage") that movably couple the first platform 130 and the second platform 140. Upper members 152 and 162 of the first and second linkage assemblies 150 and 160 can be fixedly attached to the stationary portions of the swim platform assembly 100.

The first linkage assembly 150 and a second linkage assembly 160 include multiple links, joints, slots, and bushings that are designed to control and constrain the movements of the first platform 130 and the second platform 140 so that the platforms 130 and 140 can be reconfigured between the deployed configuration (e.g., FIG. 5) and the retracted configuration (e.g., FIG. 6) as illustrated in the figures.

The components of linkages 150 and 160 can be made from various types of materials and combinations of materials. For example, in some embodiments the components of the linkages 150 and 160 are made of stainless steel, aluminum, brass, polymeric materials, and the like. The linkages 150 and 160 can also include one or more links, pivot points, arms, joints, slots, bearings and/or bushings, pins, hinges, and the like, so that the linkages 150 and 160 can be reconfigured to cause the deployable steps 120 to retract and deploy.

In the depicted embodiment, the two linkages 150 and 160 are configured as mirror images of each other, but that is not a requirement in all embodiments. In some embodiments, the two linkages 150 and 160 are configured differently from each other.

The upper members 152 and 162 each define two slots that slidably receive multiple bushings. The bushings travel along the slots and are attached to links and/or brackets that are movably driven by linear actuators 154 and 164. Accordingly, the slots and the other joints, brackets, and links of the linkages 150 and 160 control and constrain the movements of the first platform 130 and the second platform 140 so that the platforms 130 and 140 can be reconfigured between the deployed configuration and the retracted configuration.

The linear actuators 154 and 164 provide the mechanical force for reconfiguring the steps 120 between the deployed configuration and the retracted configuration. As the linear actuators 154 and 164 are extended and/or retracted, the linkages 150 and 160 are forcibly moved in relation to the upper members 152 and 162 and in relation to the boat 10 (FIG. 1). The steps 120, in turn, are thereby deployed or retracted in relation to the boat 10. In the depicted embodiment, an extension of the linear actuators 154 and 164 causes the steps 120 to retract (FIG. 6), and a retraction of the linear actuators 154 and 164 causes the steps 120 to deploy (FIG. 5). In some embodiments, a full stroke of the linear actuators 154 and 164 is used to deploy and retract the steps 120.

In the depicted embodiment, the linear actuators 154 and 164 are electrically motorized (e.g., like submersible motorized actuators that can be used for trimming motors or outdrives). In some embodiments, the linear actuators 154 and 164 are hydraulic cylinders. In some embodiments, a rack and pinion arrangement is used as part of the linear actuators 154 and 164.

As the linear actuators 154 and 164 drive the steps 120 from the retracted configuration to the deployed configuration, the linkage assemblies 150 and 160 control the platforms 130 and 140 to move in the following manners.

The first platform 130 pivots or rotates as it is deployed and/or retracted. The first platform 130 includes a first surface 131 and a second surface 132 (opposite of the first surface 131). In accordance with the pivoting/rotating motion of the first platform 130, the first surface 131 of the first platform 130 faces upward while the steps 120 are in the retracted configuration, and the second surface 132 of the first platform 130 faces upward while the steps 120 are in the deployed configuration. In some embodiments, the first platform 130 pivots by an angle of at least ninety degrees as the first platform 130 is deployed and/or retracted. In some embodiments, the first platform 130 pivots by an angle in a range of 90 degrees to 120 degrees, or 120 degrees to 150 degrees, or 150 degrees to 160 degrees, or 160 degrees to 170 degrees, or 170 degrees to 179 degrees, or 160 degrees to 179 degrees, or 150 degrees to 179 degrees, without limitation.

The second platform 140 translates downward as the steps 120 are deployed. The second platform 140 translates upward as the steps 120 are retracted. Accordingly, the same surface of the second platform 140 faces upward in both the retracted and the deployed configurations. In other words, unlike the first platform 130, the second platform 140 does not pivot to the extent that opposite surfaces of the second platform 140 face upward in the retracted configuration versus the deployed configuration. The second platform 140 pivots less than 90 degrees as it transitions between the retracted and the deployed configurations. In some embodiments, the second platform 140 pivots by an angle in a range of 0 degrees to 20 degrees, or 20 degrees to 60 degrees, or 0 degrees to 10 degrees, or 10 degrees to 30 degrees, or 0 degrees to 5 degrees, or 5 degrees to 15 degrees, or 10 degrees to 20 degrees, without limitation.

Figure 7:
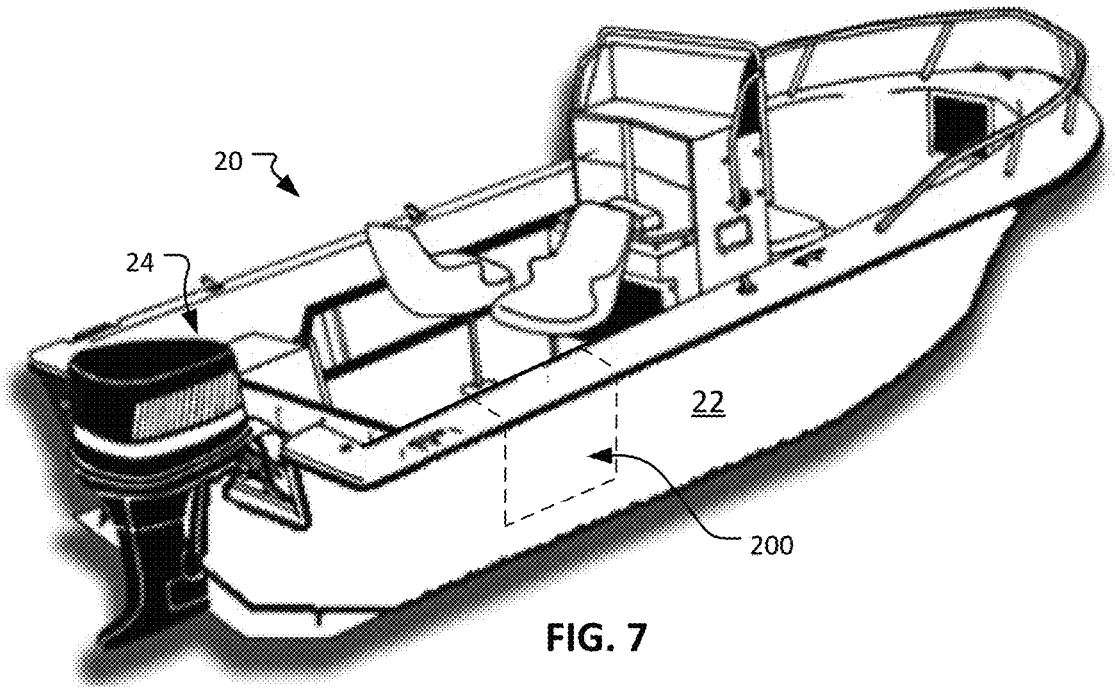
FIGS. 7 and 8 are perspective views of a boat that is powered by an outboard motor. The boat includes a side-entry deployable step system in accordance with some embodiments.
Figure 8:
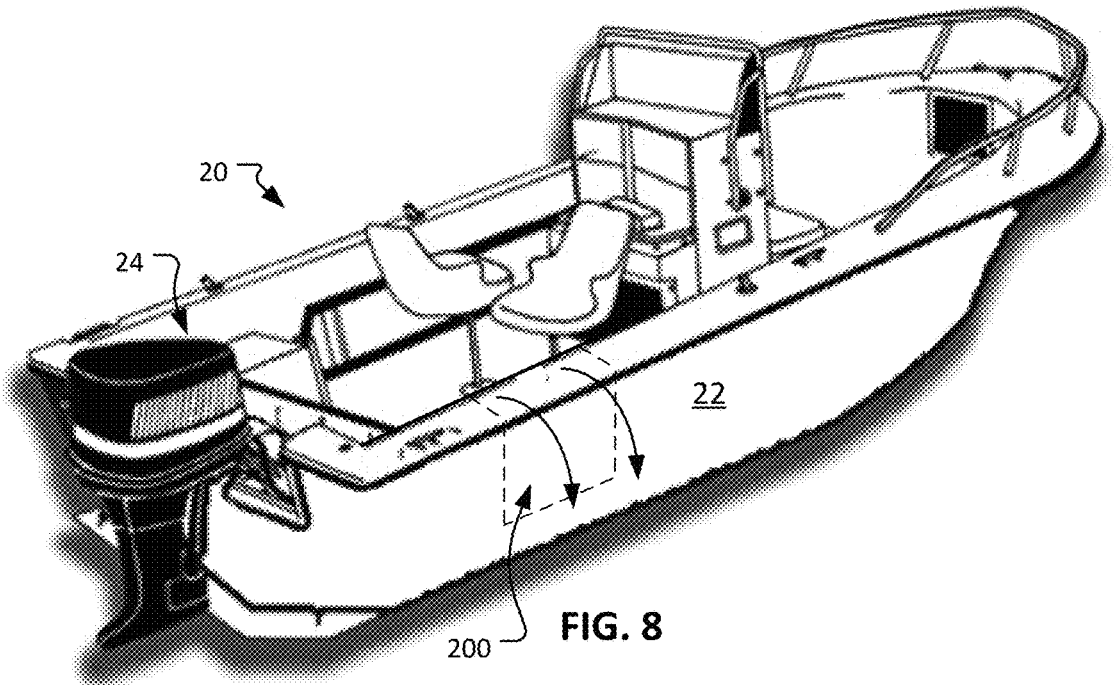

Referring to FIGS. 7 and 8, in some embodiments a side door assembly 200 can be integrated into a hull 22 of a boat 20. While the boat 20 can be almost any type of boat, in this example the boat 20 is powered by one or more outboard motors 24. The side door assembly 200 can be pivotable from a closed position (as shown in FIG. 7) to an open position in which an opening in the side hull 22 is created (as inferred in FIG. 8). Such a side-entry can be conveniently used as an access point for boarding onto the boat 20 and for un-boarding from the boat 20, for example.

Figure 9:
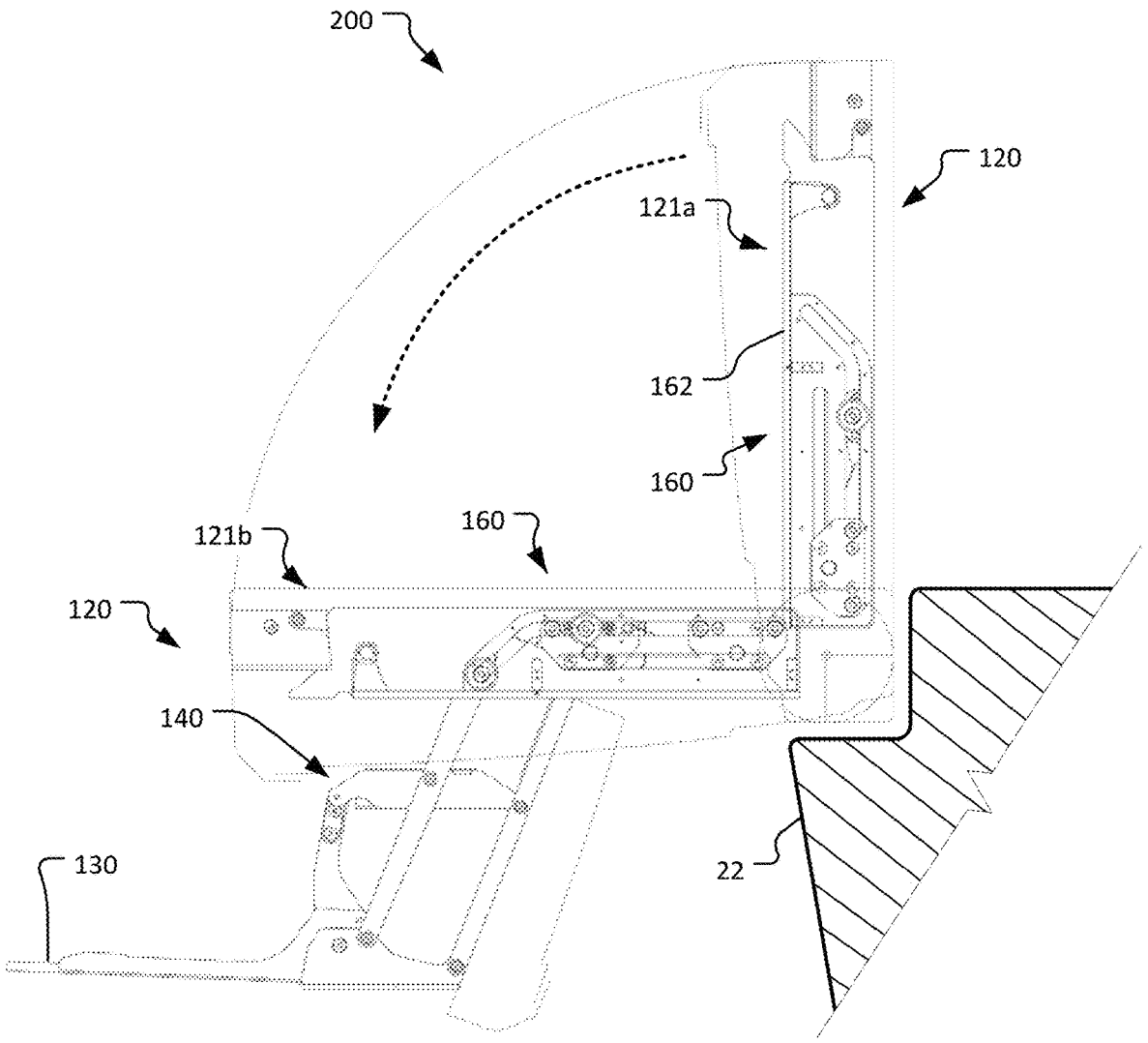
FIG. 9 is a cross-sectional view of the side-entry deployable step system of FIGS. 7 and 8.

As shown in FIG. 9, the side door assembly 200 includes the integrated system of steps 120. The integrated system of steps 120 can be reoriented between an upright position 121*a* in which the side door assembly 200 is closed and a horizontal position 121*b* in which the side door assembly 200 is open. In the closed or upright position 121*a*, the side door assembly 200 with the system of steps 120 is integrated with the hull 22, effectively comprising a portion of the hull 22. In the open or horizontal position 121*b*, the side door assembly 200 with the system of steps 120 extends laterally from the hull 22.

In the depicted embodiment, the side door assembly 200 with the integrated system of steps 120 is pivotable between the upright position 121*a* and the horizontal position 121*b*. The pivoting of the side door assembly 200 may be actuated manually in some embodiments. In some embodiments, the pivoting of the side door assembly 200 may be actuated by one or more electrical or hydraulic actuators.

While the side door assembly 200 with the system of steps 120 is in the horizontal position 121*b*, the steps 120 are selectively deployable, as described above in reference to FIGS. 2-6 (and below).

Additional Optional Features and Variations

In some embodiments, a manual switch located on the transom of the boat is used to actuate the deployment and retraction of the steps 120. In some such embodiments, the location of the switch is far enough away from the steps 120 such that a person cannot activate the switch while being in the area in which the steps 120 are moving. In some such embodiments, the person actuating the manual switch is required to continuously maintain force on the switch in order to keep the steps 120 moving. Otherwise, if the switch is released, the steps 120 will stop moving and remain in the current position.

In some embodiments, while the steps 120 are moving an audible alarm is sounded. For example, a "beep-beep" noise can be sounded to alert people to the fact that the steps 120 are moving and that they should stay away for safety sake.

In some embodiments, the steps 120 are safety interlocked such that they will not deploy if the boat's engines are running. In some embodiments, the boat's engine(s) will not start if the steps 120 are not fully retracted.

In some embodiments, an interlock is included that prevents engines or outdrives from being trimmed upward while the steps 120 are deployed. Additionally, in some embodiments the steps 120 are prevented from deploying while the engines or outdrives are trimmed in an up position.

In some embodiments, one or more sensors are included to enhance safe operations of the deployable steps 120. For example, in some embodiments one or more tape-switches are positioned along the edges of the swim platform member and/or steps 120 to prevent pinching therebetween (by deactivating movement of the linear actuators 154 and 164 in response to a triggering of the tape-switches). In some embodiments, one or more optical sensors (or other types or sensors) can similarly be included to enhance safe operations of the swim platform assembly 100.

While this specification contains many specific implementation details, these should not be construed as limitations on the scope of any invention or of what may be claimed, but rather as descriptions of features, that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A watercraft comprising:

a hull including a port side wall and a starboard side wall; and a system of steps integrated with the port side wall or the starboard side wall and comprising:

a first platform;

a second platform; and a linkage that is pivotably coupled to the hull such that the system of steps is reconfigurable between: (a) a closed position in which the system of steps comprises a portion of the port side wall or the starboard side wall and (b) an open position in which an opening in the port side wall or the starboard side wall is created, wherein the linkage movably couples the first and second platforms together such that, when the system of steps is in the open position, the first and second platforms are reconfigurable between: (i) a retracted configuration in which the system of steps forms a single platform and (ii) a deployed configuration in which the first and second platforms form two steps.

2. The watercraft of claim 1, wherein the system of steps further comprises a first panel, and wherein during the reconfiguring of the first and second platforms from the retracted configuration to the deployed configuration:

the first and second platforms each move to form the two steps, and the first upright panel moves to create a backrest between the first and second platforms.

3. The watercraft of claim 1, further comprising a first actuator coupled to the linkage and operable to drive reconfiguration of the system between the retracted configuration and the deployed configuration.

4. The watercraft of claim 1, wherein the linkage includes a hard stop such that while the system is in use in the deployed configuration the hard stop bears forces applied by the use rather than the actuator.

5. The watercraft of claim 1, wherein as the first and second platforms reconfigure from the retracted configuration to the deployed configuration: (i) the first platform pivots by at least ninety degrees and (ii) the second platform pivots less than 90 degrees.

6. The watercraft of claim 1, further comprising a second actuator operable to drive the pivoting of the system of steps between the closed and open positions.

7. The watercraft of claim 1, wherein the first platform is above the second platform while the system is in the retracted configuration.

8. The watercraft of claim 7, wherein the first platform is below the second platform while the system is in the deployed configuration.

9. The watercraft of claim 1, further comprising a second upright panel disposed between the first and second platforms while the system is in the deployed configuration.

10. The watercraft of claim 1, wherein the system of steps is positionable in three arrangements that include:

the closed position;

the open position with the first and second platforms in the retracted configuration; and the open position with the first and second platforms in the deployed configuration.

* * * * *